United States Patent [19]

Gonella

[11] Patent Number: 4,801,079

[45] Date of Patent: Jan. 31, 1989

[54] HIGH CAPACITY COLLAPSIBLE CONTAINER

[76] Inventor: Federico Gonella, Via Lacaita, 2, 20138, Milan, Italy

[21] Appl. No.: 144,551

[22] Filed: Jan. 15, 1988

[30] Foreign Application Priority Data

Jan. 22, 1987 [IT] Italy ..... 20594/87[U]

[51] Int. Cl.[4] ..... B65D 5/18

[52] U.S. Cl. ..... 229/174; 229/23 R; 229/49; 229/198

[58] Field of Search ..... 229/162, 174, 175, 192, 229/198, 913, 23 R, 49, DIG. 11, 918, 122

[56] References Cited

U.S. PATENT DOCUMENTS

| | | | |
|---|---|---|---|
| 953,132 | 3/1910 | Fischer | 229/162 |
| 1,963,603 | 6/1934 | Williams | 229/23 R |
| 2,089,345 | 8/1937 | Davis et al. | 229/23 R |
| 2,201,462 | 5/1940 | Wells et al. | 229/198 |
| 2,269,247 | 1/1942 | Borah | 229/23 R |
| 2,791,366 | 5/1957 | Geisler | 229/198 |
| 2,862,425 | 12/1958 | Swaim et al. | 229/176 |
| 3,136,184 | 11/1938 | Fellowes | 229/176 |
| 3,214,077 | 10/1965 | Schwartz | 229/913 |
| 3,338,503 | 8/1967 | Beh | 229/122 |

*Primary Examiner*—Stephen Marcus
*Assistant Examiner*—Gary E. Elkins
*Attorney, Agent, or Firm*—Bucknam and Archer

[57] ABSTRACT

The container comprises a box-like body closable by a cover and made of a die cut element forming the container bottom and side walls and coupled to a front wall and rear wall by means of bosses engageable in flaps of the die cut element adapted to be superimposed on the edges of the front and rear walls.

2 Claims, 2 Drawing Sheets

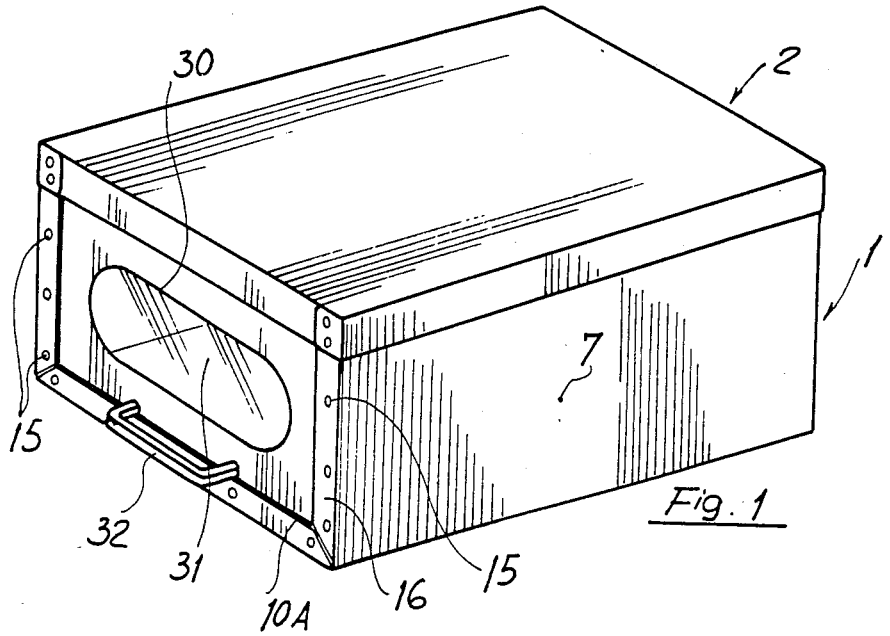
Fig. 1
Fig. 2
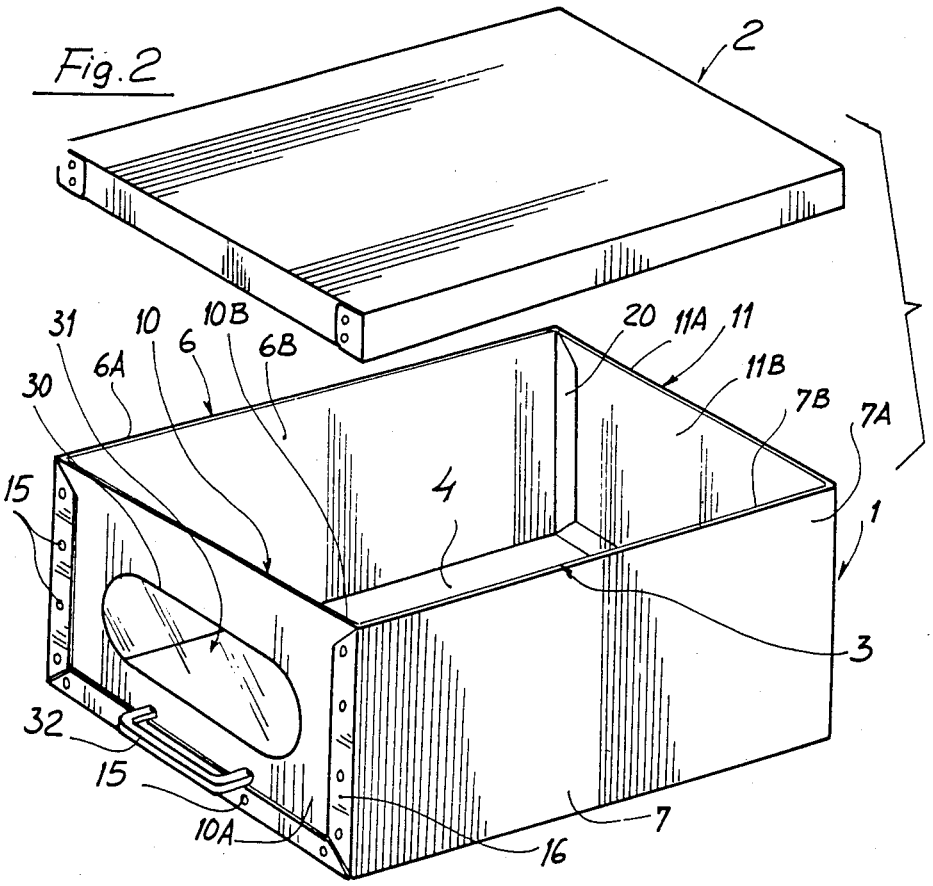

HIGH CAPACITY COLLAPSIBLE CONTAINER

BACKGROUND OF THE INVENTION

The present invention relates to a high capacity collapsible container.

As is known, in many filed such as the market and home fields, there are required high capacity containers for receiving therein, in an ordered manner, several types of articles.

Known solutions, on the other hand, are not completely satisfactory because they generally provide for the use of specifically designed shelvings or cabinets, which may be displaced and modified with difficulty.

Another drawback of known large size box-like structures is that they do not afford the possibility of observing from the outside the contained articles. Also in this case, moreover, these large boxes can be handled in a rather difficult way, mainly as several boxes are superimposed onto one another.

Yet another drawback of the mentioned large boxes is that they can not be collapsed and thus they require a large space, mainly as they are to be transported in an empty condition.

SUMMARY OF THE INVENTION

The main object of the present invention is to overcome the above mentioned drawbacks by providing a high capacity container which may be easily and quickly collapsed to reduce its volume to a minimum, practically coinciding with the thickness of its walls.

Another object of the present invention is to provide a high capacity container which may be easily handled.

Another object of the present invention is to provide such a high capacity container affording the possibility of clearly observing, from the outside, the articles contained therein.

Yet another object of the present invention is to provide a high capacity container which may be directly assembled by the user, without the use of complex apparatus and which, moreover, is very competitive from a mere economic stand point.

According to one aspect of the present invention, the above mentioned objects, as well as yet other objects, which will become more apparent hereinafter, are achieved by a high capacity collapsible container consisting of a box-like body closable by a conver, characterized in that said box-like body is made of a die cut element forming the bottom and side walls of said box-like body, said die cut element being coupled to a front wall and a rear wall, by means of throughgoing bosses adapted for engaging with flaps of said die cut element, said flaps being adapted to be superimposed on the edges of said front and rear walls.

BRIEF DESCRIPTION OF THE DRAWINGS

Further characteristics and advantages of the present invention will become more apparent hereinafter from the following detailed description of a high capacity collapsible container according to the invention, which is illustrated, by way of an indicative but not limitative example, in the figures of the accompanying drawings, where:

FIG. 1 is a schematic perspective view illustrating the container according to the invention in its closed condition;

FIG. 2 is an exploded perspective view of the container according to the invention, with the cover separated from the container box-like body;

DESCRIPTION OF THE PREFERRED EMBODIMENT

Figure 3:
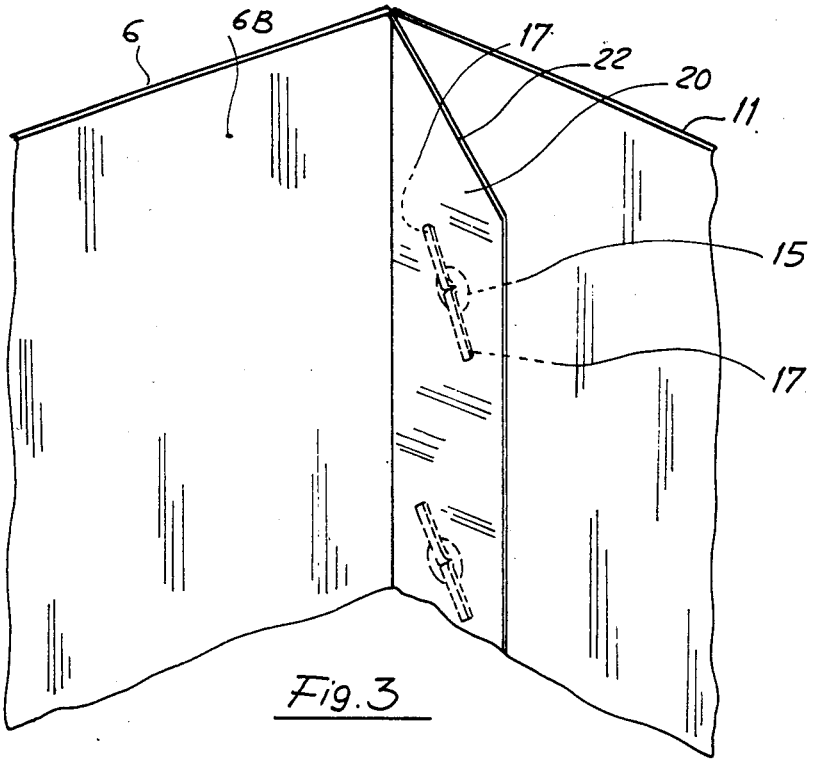
FIG. 3 is a detail view illustrating a corner portion of the container according to the present invention, showing by dashed lines coupling bosses used for forming the subject container.
Figure 4:
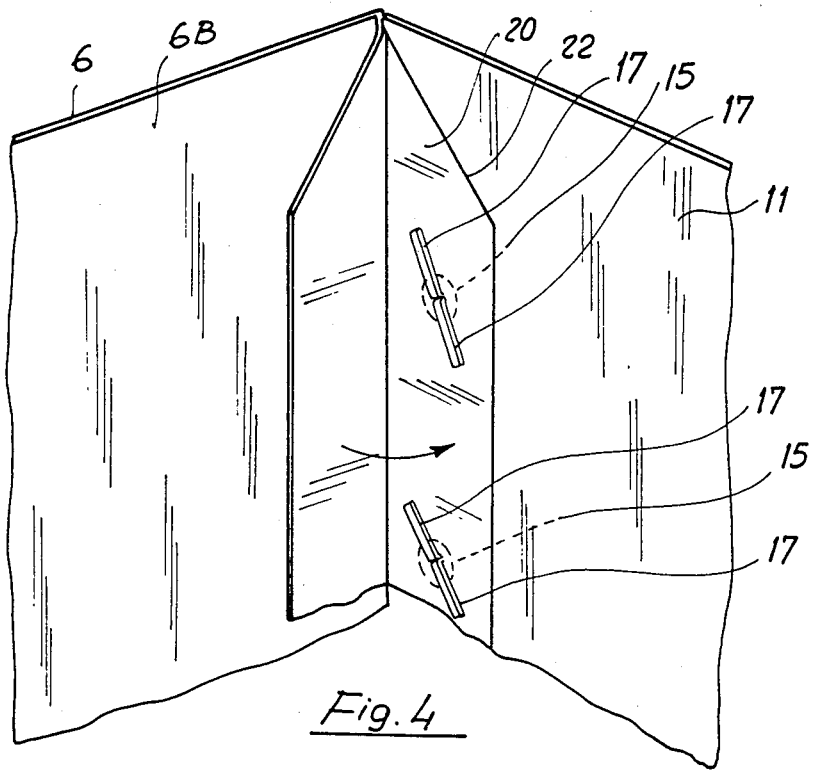
FIG. 4 illustrates an inside corner zone of the container, with the boss protecting flap represented in a raised condition, for clearly showing said bosses.

With reference to the figures of the accompanying drawings, the high capacity collapsible container according to the present invention, comprises a box-like body 1 which may be closed by a cover 2.

The main feature of the present invention is that the box-like body 1 is made of a die-cut element, of plasticized paper board or other suitable sheet materials, indicated overally at the reference number 3.

More specifically said die cut element 3 is bent so as to define, with its central portion, the bottom 4 of the container and, with its sides, respectively the left side wall 6 and right side wall 7 of the container.

The side walls 6 and 7 are made as a double layer by bending again the die cut element at the free upper edge of the box-like body, so as to reinforce said walls, which are provided with an outer face, 6A and 7A respectively, and an inner face, indicated respectively at 6B and 7B.

In this connection it should be pointed out that the front wall 10 and rear wall 11, also made of die cut elements which form the outer faces, respectively indicated at 10A and 11A, and the inner faces, respectively indicated at 10B and 11B, are coupled to the die cut element 1 by means of a plurality of bosses 15.

These bosses 15 are applied, in a throughgoing manner, to the flaps 16 provided at the end of the die cut element 3 and bent so as to be superimposed on the outer edges of the mentioned walls 10 and 11.

More specifically, said bosses are simply affixed by spreading apart the tabs 17, coupled to said bosses, so as to afford the possibility of seeing from outside the heads of the bosses 15, whereas the tabs 17 are inwardly bent.

In order to prevent the bent tabs from possibly damaging a person, protection fins 20 are provided inside the box-like body which protection fins are associated with the die cut element 3, respectively with its inner side walls 6B and 7B which are superimposed on the tabs and are housed in suitable recessed regions 22 provided to that end on the inner faces 10B and 11B of the front and rear walls.

Another main feature of the present invention is that the front wall 10 is provided with a window 30 covered by an optically transparent panel 31, which affords the possibility of observing the articles contained in the container.

Moreover, on the front wall 10 there is provided a gripping handle 32, arranged near the container bottom, so as to afford the possibility of easily handling the filled or empty container.

The cover too is made of a die cut element, which is bent at the corners thereof and restrained by means of bosses.

From the preceding disclosure it should be apparent that the invention fully achieves the intended objects.

In particular the fact is to be pointed out that a high capacity collapsible container has been provided which may be simply and quickly constructed starting from a simple die cut element which is assembled by means of bosses which are protected by protecting fins provided on the inner surface of the container.

While the container according to the invention has been disclosed and illustrated with reference to a preferred embodiment thereof, it should be apparent that the disclosed embodiment is susceptible to many modifications and variations, all of which come within the spirit of the invention and the scope of the appended claims.

I claim:

1. A high capacity collapsible container comprising a box-like body having a bottom, a front wall, a rear wall and side walls and a closing cover, said front and rear walls having respective inner and outer faces and said side walls having respective inner and outer faces, said box like body being made of a die cut element forming said bottom and side walls, said die cut element being coupled to said front wall and rear wall by throughgoing bosses engageable in flaps of said die cut element adapted to be superimposed on said front and rear walls, said die cut element being provided with a central portion forming said bottom, said bottom having transverse and longitudinal sides, said die cut element being upwardly bent at said longitudinal sides of said bottom and then being downwardly bent so as to provide said inner and outer faces of said side walls, said container further including, at said bosses, a plurality of protecting fins provided on extensions of said inner faces of said side walls.

2. A high capacity collapsible container, according to claim 1, wherein said inner faces of said front and rear walls and provided with recessed regions for housing said protecting fins.

* * * * *